US007325390B2

(12) United States Patent
Stahlecker et al.

(10) Patent No.: US 7,325,390 B2
(45) Date of Patent: Feb. 5, 2008

(54) TWIN UNIT COMPRISING TWO DRAFTING DEVICES FOR A SPINNING MACHINE

(75) Inventors: Gerd Stahlecker, Eislingen/Fils (DE); Gernot Schaeffler, Waeschenbeuren (DE)

(73) Assignee: Maschinenfabrik Rieter AG, Winterthur (CH)

( * ) Notice: Subject to any disclaimer, the term of this patent is extended or adjusted under 35 U.S.C. 154(b) by 0 days.

(21) Appl. No.: 11/446,155

(22) Filed: Jun. 5, 2006

(65) Prior Publication Data

US 2006/0272132 A1 Dec. 7, 2006

(30) Foreign Application Priority Data

Jun. 6, 2005 (DE) ..... 10 2005 027 193

(51) Int. Cl.
*D01H 5/74* (2006.01)

(52) U.S. Cl. ..... 57/315; 19/258

(58) Field of Classification Search ..... 57/315; 19/236, 258

See application file for complete search history.

(56) References Cited

U.S. PATENT DOCUMENTS 5,010,624 A * 4/1991 Stahlecker ..... 19/261
5,012,557 A * 5/1991 Stahlecker et al. ..... 19/258
5,157,911 A * 10/1992 Stahlecker et al. ..... 57/328

FOREIGN PATENT DOCUMENTS

DE 39 04 348 A1 8/1990
EP 1 422 323 A2 5/2004

* cited by examiner

*Primary Examiner*—Shaun R. Hurley
(74) *Attorney, Agent, or Firm*—Crowell & Moring LLP

(57) ABSTRACT

A twin unit has two drafting devices for drafting fiber strands and is applicable in a spinning machine. The twin unit includes a common housing for the two drivable drafting devices, whereby the housing is detachably mounted in a machine frame. The drafting devices include a number of drivable bottom rollers and are arranged essentially mirror-symmetrical to one another. Each bottom roller has an area which drafts the fiber strand and is characterized in that the bottom roller has two bearing points. The two bearing points of each bottom roller are arranged one on either side of the area which drafts the fiber strand. In one variation, at least two opposite bottom rollers may form a bottom roller pair, in which the bearing points facing to the plane of symmetry of the twin unit are taken up in a joint bearing take-up. In addition, a top roller in the form of a twin pressure roller may be assigned to a bottom roller pair.

8 Claims, 2 Drawing Sheets

TWIN UNIT COMPRISING TWO DRAFTING DEVICES FOR A SPINNING MACHINE

BACKGROUND AND SUMMARY OF THE INVENTION

This application claims the priority of German Application No. 10 2005 027 193.6, filed Jun. 6, 2005, the disclosure of which is expressly incorporated by reference herein.

The present invention relates to a twin unit including two drafting devices for drafting fiber strands for a spinning machine. One housing is provided for both of the drafting devices, which housing is mounted in a detachable way on a machine frame. Each of the drafting devices can be driven separately, whereby the drafting devices are arranged essentially mirror-symmetrical to one another and include a number of drivable bottom rollers, and whereby each bottom roller includes an area which drafts the fiber strand.

A spinning machine built in modular design is known in European published patent application 1 422 323. A number of self-supporting spinning units attached to a machine frame are provided there in machine longitudinal direction, which units serve the production of yarn. Each spinning unit can, as a module, be simply replaced. In the case of airjet spinning machines, these spinning units include at least one drafting device, a drive and an airjet assembly. The drafting device of each individual spinning position can be separately driven.

In the case of drafting devices of this type which are driven separately, it is standard practice to support the bottom rollers in an overhung position. The bottom rollers are hereby supported only on their ends facing the housing, while the area of the bottom roller which drafts the fiber strand projects upwards from the frame and has there no further bearing point.

For reasons of efficient use of space it is intended that, in the spinning machine, the smallest possible gauge, that is the smallest possible distance between each spinning position, is realized. The spinning units having a complete housing for each individual drafting device and the overhung supported bottom rollers therein have the disadvantage in that they set limits to the reduction of the gauge.

The overhung supporting arrangements have the disadvantage in that they require a very complicated bearing of large dimensions. The shorter the bearing is designed, the higher the bearing forces are.

From the German published patent application 39 04 348 it is known that such drafting devices having overhung supported bottom rollers are designed as twin units, in which two drafting devices are arranged in a common housing. Both drafting devices are arranged essentially mirror-symmetric to one another and are driven separately. Due to the mirror-symmetrical assembly as a twin unit, a little saving of space can be achieved, but because of the overhung supported bottom rollers, quite a large installation space is still required.

There is therefore needed a spinning unit in which the space requirements in a longitudinal direction of the spinning machine are reduced, thus permitting a smaller gauge.

These needs are achieved in that each bottom roller includes two bearing points, whereby one bearing point is arranged on each side of the area which drafts the fiber strand.

By placing two bearing points essentially at both ends of the bottom rollers, the bearing forces are reduced and the bearing points can be of smaller dimensions. The support of the bottom roller on both sides of the area which drafts the fiber strand avoids a multiplication of the forces mainly occurring due to the pressure of the assigned top rollers, as such multiplication occurs in the case of the overhung support. Rather, the load is divided almost evenly between both bearing points.

Due to the mirror-symmetric arrangement, both bottom rollers, which lie opposite one another on either side of the plane of symmetry of the twin unit, may be defined as a bottom roller pair. These bottom roller pairs of both drafting devices of the twin unit are often only jointly adjusted in their position along the fiber transport direction. It is then advantageous when the bearing points facing the plane of symmetry include a joint bearing take-up. Design and adjustability are hereby simplified, and further installation space can be saved by placing the bearing points accordingly.

Flexibly pressable top rollers are arranged with respect to the bottom rollers of the drafting device. The top rollers can be supported and pressed in different ways. If it is necessary that individual top rollers be raised separately, then these top rollers are advantageously individually supported and pressed. In order to further reduce space requirements, it may be advantageous to design as many top rollers as so-called twin pressure rollers. The two top rollers of a so-called bottom roller pair are hereby rotatably supported on a joint stationary axle and pressed by a joint loading assembly.

It is in addition advantageous to assign to each drafting device at least one separate drive motor, which is also arranged in the housing of the twin unit. Thus, each drafting device can be individually controlled and also brought to standstill in a simple way.

These and further objects, features and advantages of the present invention will become more readily apparent from the following detailed description thereof when taken in conjunction with the accompanying drawings wherein.

DETAILED DESCRIPTION OF THE DRAWINGS

Figure 1:
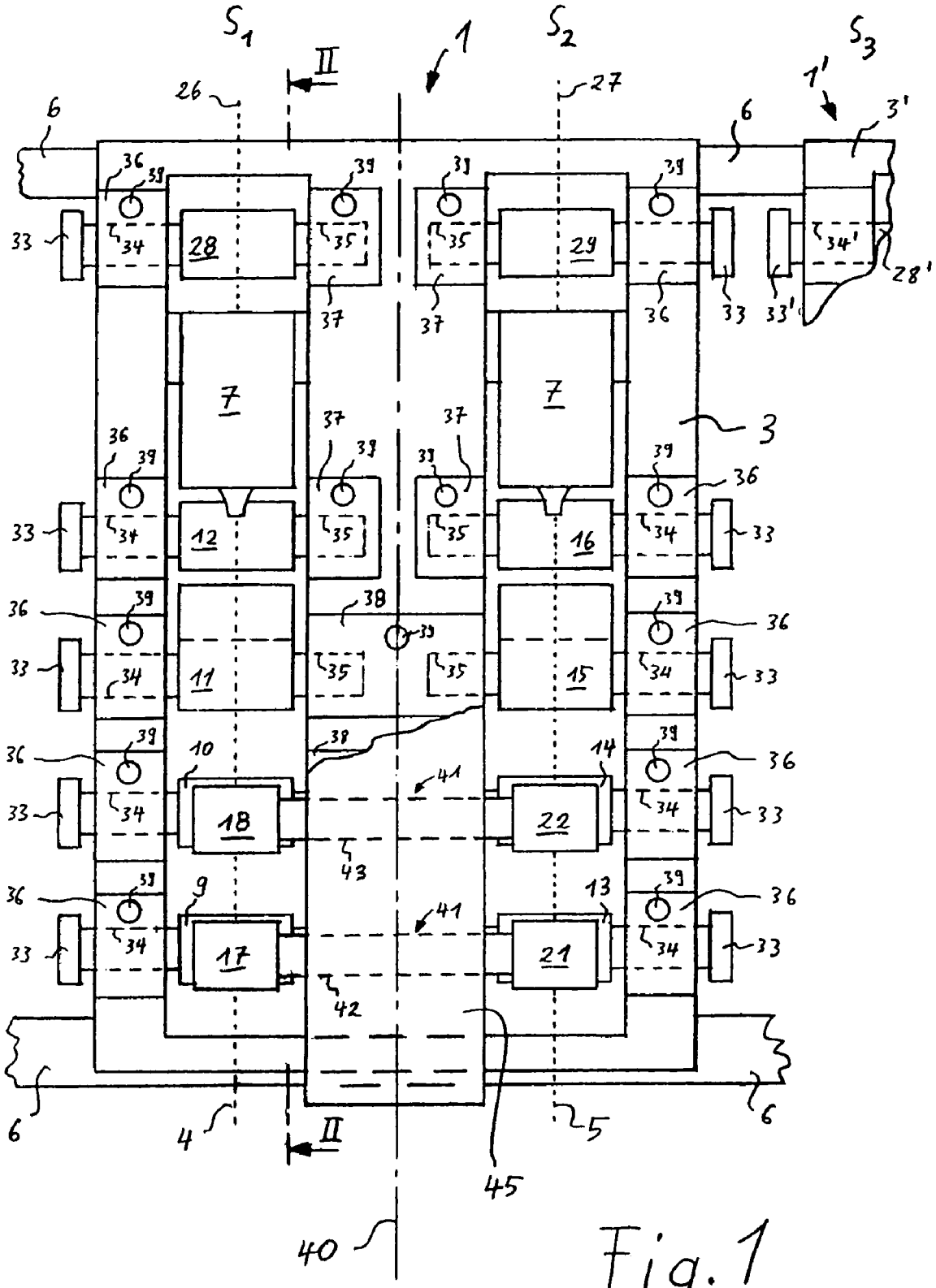
FIG. 1 shows a top view of a twin unit including two drafting devices, whereby a number of top rollers have been omitted for reasons of clarity.
Figure 2:
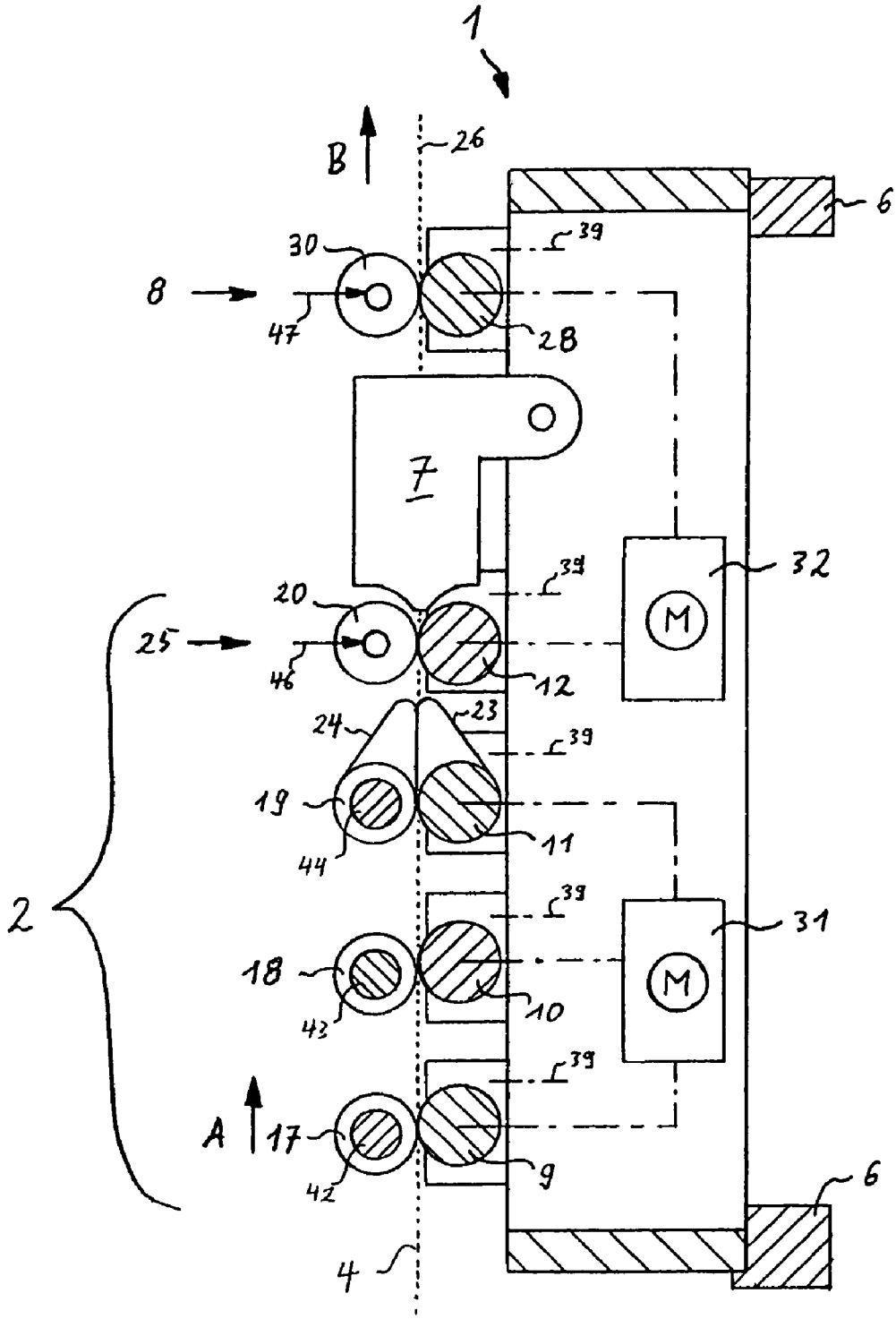
FIG. 2 shows an intersectional view of the twin unit along the surface II-II.

The twin unit 1 according to FIGS. 1 and 2 includes two drafting devices 2 in a common housing 3. The drafting devices 2 are arranged to form two adjacent spinning positions $S_1$ and $S_2$ of a spinning machine and serve in the known way to draft fiber strands 4 and 5 to the desired degree of fineness.

The housing 3 of the twin unit 1 is releaseably attached to a machine frame 6 which extends in machine longitudinal direction. Along the spinning machine a number of twin units 1 having a number of spinning positions S are arranged on the machine frame 6. The adjacent twin unit 1' of the next spinning position $S_3$ is denoted in FIG. 1, wherein like components are illustrated with the same reference numbers as, for example, (1', 3', 28', 33', 34'). The distance between the spinning positions $S_1$, $S_2$, $S_3$, . . . is identical, and is referred to as the gauge of the spinning machine.

The spinning twist imparted to the drafted fiber strands 4, 5 can take place in a variety of known ways, for example by way of airjet assemblies 7. The airjet assemblies 7 may be arranged together with the drafting devices 2, as well as the withdrawal roller pairs 8 in the housing 3 of the twin unit 1. The twin unit 1 may form in an advantageous way a complete spinning unit, which, as a compact module, may be installed and dismantled in the spinning machine in a simple way.

The shown drafting devices 2 are designed as four cylinder drafting devices, but could just as well alternatively be designed as three cylinder drafting devices.

The drafting devices 2 each comprise four bottom rollers 9, 10, 11, 12 and 13, 14, 15, 16, which are arranged one behind the other in fiber transport direction A and which are drivable at increasing speeds. Top rollers 17, 18, 19, 20, 21, 22 are arranged respectively to the bottom rollers 9 to 16. For reasons of clarity, the top rollers 19, 20 belonging to the bottom rollers 11, 12, 15, 16 are not shown in FIG. 1.

The top rollers 17 to 22 are flexibly pressed against the bottom rollers 9 to 16 and are thus taken along. In order to improve the quality of the drafted fiber strands 4, 5, guiding belts 23, 24 can loop the bottom rollers 11, 15 and the top rollers 19 in the known way.

The fiber strands 4, 5 are fed downstream of the front roller pairs 25 of the drafting devices 2 to the twist devices, which are designed as airjet assemblies 7 in the shown embodiment. The formed threads 26, 27 are fed by the withdrawal roller pairs 8 in withdrawal direction B to winding devices (not shown) of the spinning machine. The withdrawal roller pairs 8 also include driven bottom rollers 28, 29, and top rollers 30, which are flexibly pressed against the bottom rollers 28, 29, whereby the top rollers 30, belonging to the bottom rollers 28, 29 are again not shown in FIG. 1.

The bottom rollers 9 to 12 and 28 of the spinning position $S_1$ are driven by the motors 31, 32 as denoted by the dot-dash line, which are also advantageously applied to the housing 3. The bottom rollers 13 to 16 and 29 of the second spinning position $S_2$ of the twin unit 1 are driven in the same way by two motors (not shown). The power transmission may take place via drive gears 33 in the form of toothed belt pulleys.

In one aspect of the present invention, the bottom rollers 9 to 16 and 28, 29 are supported in such a way that, in comparison to the above mentioned prior art, a reduction in the amount of space required is achieved. The gauge of the spinning machine is to be reduced, so that a spinning machine with the same number of spinning positions $S_1$, $S_2$, . . . $S_N$ has a shorter overall length, and that with the same overall length, a larger number of spinning positions $S_1$, $S_2$, . . . $S_N$ can be installed.

Because each bottom roller 9 to 16 and 28, 29 includes two bearing points 34 and 35, one of which is arranged on either side of the area which guides the fiber strand 4, 5, a reduction in the bearing forces is achieved, which permits a radical reduction of the bearing points 34. Despite the additional necessary installation space for the bearing points 35, in contrast to the prior art, installation space can be reduced overall, as the bearing point 34 alone present in the overhung bearing arrangement requires more installation space in any case than the sum of the downsized bearing points 34 and the bearing points 35 together.

The bearing points 34 and 35 can be advantageously designed as roller bearings and are taken up in bearing take-ups 36, 37, 38 and affixed to the housing 3 by way of a fastener 39, for example screws. It can be provided that the bearing take-ups 36, 37, 38 are adjustable in fiber transport direction A, so that the distances between the bottom rollers 9 to 12 and 13 to 16 can be adjusted.

It is advantageous to design the drafting devices 2 of both spinning positions $S_1$ and $S_2$ of the twin unit 1 essentially mirror-symmetrical to one another. The plane of symmetry is denoted in FIG. 1 by a dot-dash line 40. A mirror-symmetrical placing of the components of the drafting devices 2 permits a further reduction of the installation space and thus also of the gauge.

In one embodiment of the present invention, it can be provided that fiber strands 4 and 5 made of identical material are processed on adjacent spinning positions $S_1$ and $S_2$. The bottom rollers 9 to 12, and 13 to 16 are so adjusted, that the axes of two bottom rollers 9 to 16 lying opposite one another on either side of the plane of symmetry 40, for example the bottom rollers 11 and 15, are aligned exactly with one another. The bottom rollers 11 and 15 thus form a bottom roller pair in a line. In this case it is advantageous to take up the bearing points 35 facing the plane of symmetry 40 of the twin unit 1 in a joint bearing take-up 38. This ensures that the respective bottom rollers 9 to 16 forming a bottom roller pair are jointly adjusted and are disposed in exact alignment with each other. If all the bearing points 35 are taken up by joint bearing take-ups 38, even more installation space can be saved by means of skilled design of the bearing take-ups 38.

The bottom rollers 9 to 16 and 28, 29 disposed opposite one another at the plane of symmetry 40 should, on no account, be connected with one another inside the joint bearing take-ups 38, as then none of the spinning positions $S_1$, $S_2$ can be autonomously driven or individually stopped in the case of an end break.

If individual bottom roller pairs of the bottom rollers 9 to 16 and 28, 29 are taken up by joint bearing take-ups 38, it can be advantageous when the respective top rollers 17 to 22 and 30 are designed as twin pressure rollers 41. A joint axle 42, 43, 44 is then assigned respectively to two top rollers 17 to 22 and 30 disposed opposite one another at the plane of symmetry 40, which axles 42, 43, 44 may also be supported by a joint loading assembly 45.

For example, the bottom rollers 10 and 14 can form, together with a joint bearing take-up 38, a so-called bottom roller pair, to which the top rollers 18 and 22 in the form of a twin pressure roller 41 are assigned. The top rollers 18 and 22 are rotatably supported on a joint stationary axle 43, whereby the axle 43 is held by the loading assembly 45.

For specific procedural steps, in particular in the case of re-starting of a temporarily stopped spinning position $S_1$ after an interruption, it may be necessary that, for example, the top roller 20 and 30 of the front roller pair 25 and of the withdrawal roller pair 8, respectively, have to be opened individually. In such a case it is advantageous to support these top rollers 20, 30 individually and to press them by way of separate loading devices 46, 47. Thus, a disruption of the spinning process at the adjacent spinning position $S_2$ is avoided if the upper rollers 20, 30 of the spinning station $S_1$ have to be opened.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A twin unit, comprising:

two drafting devices for drafting fiber strands for a spinning machine;

one housing for both of the drafting devices, which housing is mounted in a detachable way in a machine frame, wherein each of the drafting devices are drivable separately;

wherein the drafting devices are arranged essentially mirror-symmetrically to one another and comprise a number of drivable bottom rollers;

wherein each bottom roller comprises an area which drafts the fiber strand; and wherein each bottom roller has two bearing points, one bearing point being arranged on either side of the area which drafts the fiber stand.

2. The twin unit according to claim 1, wherein at least two bottom rollers disposed opposite one another at a plane of symmetry of the twin unit form a bottom roller pair, in which the bearing points facing the plane of symmetry have a joint bearing take-up.

3. The twin unit according to claim 2, wherein top rollers in the form of twin pressure rollers are assigned to at least one bottom roller pair.

4. The twin unit according to claim 1, further comprising at least one separate drive motor assigned to the bottom rollers and belonging to one drafting device.

5. The twin unit according to claim 2, further comprising at least one separate drive motor assigned to the bottom rollers and belonging to one drafting device.

6. The twin unit according to claim 3, further comprising at least one separate drive motor assigned to the bottom rollers and belonging to one drafting device.

7. A twin unit having a housing for two drafting devices, the housing being detachably mounted in a machine frame and each of the drafting devices being drivable separately, the twin unit comprising:

a plurality of drivable bottom rollers of the two drafting devices, each bottom roller having an area which drafts a fiber strand, wherein the two drafting devices are arranged essentially mirror-symmetrically with respect to one another; and two bearing points provided for each of the plurality of drivable bottom rollers, wherein one of the two bearing points is respectively arranged on each side of the area which drafts the fiber strand.

8. The twin unit according to claim 7, wherein at least two of the plurality of drivable bottom rollers are disposed opposite one another at a plane of symmetry of the twin unit to form a bottom roller pair, wherein a joint bearing take-up is provided for one bearing point facing the plane of symmetry of each of the two bottom rollers forming the bottom roller pair.

* * * * *